US008152897B2

(12) United States Patent
Lindsay

(10) Patent No.: US 8,152,897 B2
(45) Date of Patent: Apr. 10, 2012

(54) GAS/LIQUID SEPARATOR FOR HYDROGEN GENERATING APPARATUS

(75) Inventor: Andrew Harland Lindsay, Georgetown (CA)

(73) Assignee: Blutip Power Technologies Ltd., Mississauga (CA)

( * ) Notice: Subject to any disclaimer, the term of this patent is extended or adjusted under 35 U.S.C. 154(b) by 604 days.

(21) Appl. No.: 12/514,962

(22) PCT Filed: Jan. 30, 2007

(86) PCT No.: PCT/CA2007/000126

§ 371 (c)(1), (2), (4) Date: May 14, 2009

(87) PCT Pub. No.: WO2007/085093

PCT Pub. Date: Aug. 2, 2007

(65) Prior Publication Data

US 2010/0064892 A1 Mar. 18, 2010

(30) Foreign Application Priority Data

Jan. 30, 2006 (CA) ..... 2534604

(51) Int. Cl.
*B01D 46/46* (2006.01)

(52) U.S. Cl. ..... 95/22; 55/423; 55/385.1; 95/24; 95/273; 96/408; 96/412; 96/421; 96/400; 96/405; 204/270; 204/276; 204/278; 204/269; 204/275.1; 204/247

(58) Field of Classification Search ..... 55/385.1, 55/423; 95/19, 20, 24; 96/408, 409, 410, 96/411, 412, 253, 157, 161, 168, 169, 174; 210/104, 114, 115, 123, 428, 539, 741, 744; 137/172, 192, 203, 558; 205/82; 180/54.1; 123/3, DIG. 12; 204/247, 275.1, 278, 267, 204/269, 270, 276, 278.5, 288, 288.6, 289
See application file for complete search history.

(56) References Cited

U.S. PATENT DOCUMENTS 4,874,408 A * 10/1989 Overby ..... 96/408

(Continued)

FOREIGN PATENT DOCUMENTS

CA 2184995 A1 9/1995

(Continued)

*Primary Examiner* — Duane Smith
*Assistant Examiner* — Minh-Chau Pham
(74) *Attorney, Agent, or Firm* — Bennett Jones LLP

(57) ABSTRACT

A gas liquid separator system for a hydrogen generating apparatus includes a collection area for collecting liquid from the generated gases. To empty the collection area occasionally so that liquid does not build up and become entrained again in the dried gas, a vent solenoid is provided in communication with the collection area and a pump is used to create a vacuum periodically on the electrolysis cells. Such arrangement is used to open the liquid gas filter and possibly just the sump to atmosphere occasionally and vacuum generated to draw the liquid from the sump back to the electrolysis cells.

19 Claims, 2 Drawing Sheets

U.S. PATENT DOCUMENTS

| | | | | |
|---|---|---|---|---|
| 5,061,300 | A * | 10/1991 | Alexander, III | 95/24 |
| 5,145,497 | A * | 9/1992 | Maeda | 96/409 |
| 6,332,434 | B1 | 12/2001 | De Souza et al. | |
| 6,336,430 | B2 | 1/2002 | De Souza et al. | |
| 6,524,453 | B1 | 2/2003 | De Souza et al. | |
| 6,817,320 | B2 | 11/2004 | Balan et al. | |
| 6,833,205 | B2 | 12/2004 | Speranza et al. | |
| 7,240,641 | B2 | 7/2007 | Balan et al. | |
| 7,278,259 | B2 * | 10/2007 | Schmeichel et al. | 60/283 |
| 7,314,509 | B2 * | 1/2008 | Speranza et al. | 96/155 |
| 7,326,266 | B2 * | 2/2008 | Barnwell | 55/319 |
| 7,371,268 | B2 * | 5/2008 | Smith | 55/385.4 |
| 7,727,313 | B2 * | 6/2010 | Blackwood et al. | 96/134 |
| 7,740,674 | B2 * | 6/2010 | Salmon et al. | 55/319 |
| 2004/0040838 | A1 | 3/2004 | Helmke et al. | |
| 2005/0126515 | A1 | 6/2005 | Balan et al. | |
| 2007/0119707 | A1 | 5/2007 | Helmke et al. | |
| 2007/0151778 | A1 | 7/2007 | O'Bireck et al. | |
| 2008/0257740 | A1 | 10/2008 | Helmke et al. | |

FOREIGN PATENT DOCUMENTS

| | | | |
|---|---|---|---|
| CA | 2349508 | C | 12/2002 |
| WO | WO 2007/085093 | A1 | 2/2007 |
| WO | WO 2007/085092 | A1 | 8/2007 |
| WO | WO 2007/085094 | A1 | 8/2007 |

* cited by examiner

GAS/LIQUID SEPARATOR FOR HYDROGEN GENERATING APPARATUS

FIELD OF THE INVENTION

The present invention is directed to a gas/liquid separator for a hydrogen generating apparatus and a hydrogen generating apparatus including a gas/liquid separator, the hydrogen generating apparatus being, for example, for a motor vehicle.

BACKGROUND

Hydrogen generating apparatus employing electrolysis technologies have been used on motor vehicles to supplement the fuel used to drive the vehicle. The use of hydrogen as a supplemental fuel in motor vehicle engines has been proposed to increase the performance of the engine. Hydrogen and oxygen, when used as part of the air/fuel mixture for the operation of the engine, have been found to increase the performance of the engine by increasing the mileage and by reducing the amount of emissions from the engine. The hydrogen and oxygen may be generated through electrolysis of an aqueous solution, known as electrolyte, with the gases given off being mixed with the charge of fuel and air supplied to the engine.

Although hydrogen generating apparatus have proven useful, there are certain disadvantages that have limited their widespread acceptance. For example, it is sometimes difficult to appropriately dry the generated gases before they are introduced to the engine.

SUMMARY

In accordance with a broad aspect of the present invention, there is provided a gas/liquid separator for a hydrogen generating apparatus, comprising: a housing including an inlet for wet gas, an outlet for dried gas and a coalescing medium therebetween for coalescing liquid from the wet gas; a collection area in fluid communication with the housing for collecting coalesced liquid; a liquid return line from the collection area connectable to an electrolysis electrolyte line; and a pump for generating a suction effect on the liquid return line to draw coalesced liquid from the collection area.

In accordance with another broad aspect of the present invention, there is provided a hydrogen generating apparatus comprising: an electrolysis cell for generating hydrogen gas, a gas delivery line to conduct the generated hydrogen gas toward an engine into which the hydrogen gas is to be introduced; a pump on the gas delivery line operable to generate a vacuum in the electrolysis cell; gas liquid separator in the gas delivery line including a housing having an inlet for the generated hydrogen gas, an outlet for dried gas and a coalescing medium therebetween for generating coalesced liquid from the generated hydrogen gas; a collection area in fluid communication with the housing for collecting the coalesced liquid; and a liquid return line from the collection area to return the coalesced liquid to the electrolysis cell.

In accordance with yet another broad aspect, there is provided: a method for separating liquid from the generated hydrogen gas generated by an electrolysis cell, the method comprising: passing the generated hydrogen gas through a gas/liquid separator to generated coalesced liquid and dried gas; collecting the coalesced liquid; and generating a vacuum effect on a return line; and allowing the coalesced liquid to be drawn from the gas/liquid separator back to the electrolysis cell.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF VARIOUS EMBODIMENTS

Figure 1:
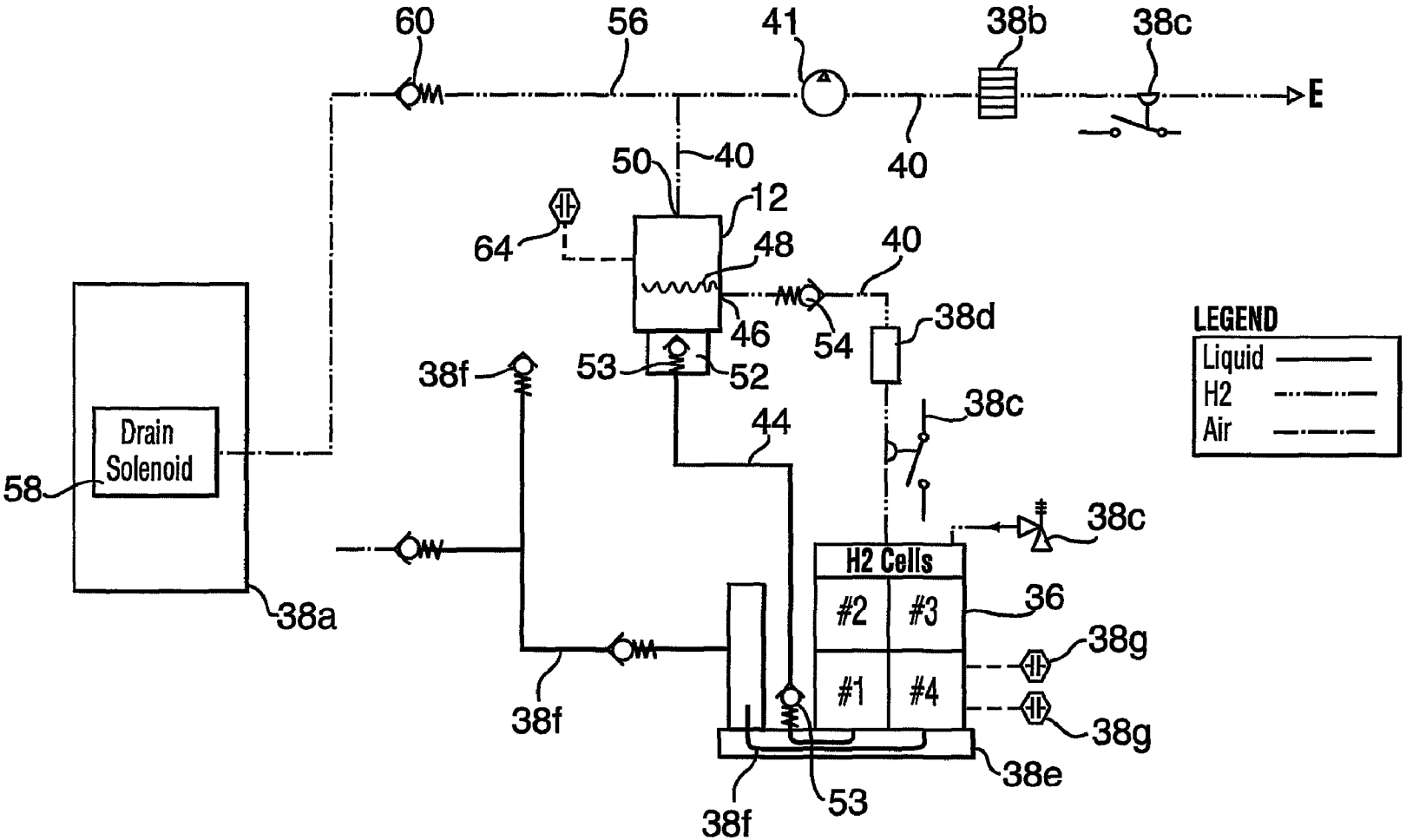
FIG. 1 is a schematic of a system according to the present invention.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

As will be appreciated, a hydrogen-generating electrolysis system for a motor vehicle may generally include three main groups of components including electrolysis cells 36, in which hydrogen gas generation occurs from an electrolyte solution by an electrolysis process conducted through electrodes (although four cells are shown, only one cell is needed for electrolysis); auxiliary components for any of controlling apparatus operation such as for example a control system 38*a*, controlling the characteristics of the conveyed gas such as, for example, a flame arrestor 38*b*, pressure switches and valves 38*c*, an expansion tube 38*d*, etc., mounting components such as, for example, base 38*e*, electrolyte fill or refill components such as for example refill lines and valves 38*f* and electrolyte level sensors 38*g*, etc.; and a gas delivery line 40 for conducting generated gas from the cells to the engine E. A pump 41 may be employed in gas delivery line 40 to selectively or continuously drive generated gases to the engine so that the gases can be injected at pressures elevated over normal production pressures or against backpressures.

In a hydrogen generation apparatus, it may be useful to separate entrained liquid from the hydrogen gas stream prior to feeding the gas into the engine. A gas/liquid separator 12, such as a filter, a condenser, etc. may be used in gas delivery line 40 to remove entrained liquid from the gas flow. Some gas/liquid separators attempt to coalesce the entrained liquid and remove it from the gas flow. Any separated liquid should generally be removed from contact with the gas flow, otherwise the liquid may again become entrained in the flow. It has been proposed to simply dispose of the entrained liquid. However, according to the present invention, liquid separated from the gas flow in the gas/liquid separator may be returned to the electrolysis cell via a return line 44. Returning the separated liquid to the electrolysis cell assists system operation by reducing the refill frequency.

Gas/liquid separator 12 is positioned in gas delivery line 40 to act on the gas before it reaches the engine. Gas flows through the separator and thus the separator includes a gas inlet 46 through which gas generated in electrolysis cells 36, which may be termed wet gas, enters the separator, a coalescing medium 48 by or through which the wet gas flows and which acts to separate entrained liquid from the gas to formed dried gas and the liquid entrained therein is coalesced and an outlet 50 through which gas exits the separator and continues on to the engine. Gas liquid separator 12 may include a liquid collection area 52 where separated liquid may collect before passing through return line 44.

Return line 44 may include one or more check valves 53 to prevent reverse flow from cells 36 to separator 12.

While in some systems liquid may migrate through return line 44 to cell, it may be necessary to occasionally draw the liquid from collection area 52, into return line 44 and therethrough back to electrolysis cells 36. In such a system, pump 41 may be used to create a vacuum in the electrolysis cells to create a suction effect on return line 44 and collection area 52. In order to allow the suction effect to draw liquid from the collection area, the coalesced liquid in area 52 should be at a pressure equal to or greater than that generating the suction effect. Thus, a vent may be provided to open separator 12 to atmosphere to permit the liquid in collection area 52 to be conducted through the return line.

In one embodiment, for example, pump 41 may be positioned to draw generated gases through the gas delivery line. As such, pump 41 may be operated to create a vacuum in cells 36. If pump 41 is operated when the electrolysis process is shut down, any vacuum established in cells 36 may be maintained for at least a period of time by check valve 54, even after the pump is shut down. As such, pump 41 may be used to create a suction effect on cells 36 and fluid in flow communication therewith including liquid refill and fill lines **38*f* and return line 44. A check valve 54 may be provided in gas delivery line 40 to permit gas flow from cells 36 to the pump, but to resist reverse flow. Check valve 54 may be employed for various reasons including holding a vacuum pressure on cells 36, even if pump is shut down. As will be more fully appreciated by the further description herein below, for the present system, check valve 54 may be positioned between separator 12 and cells 36**.

If necessary, the vent may be provided in collection area or in other areas of the separator or gas delivery lines that are in fluid communication with collection area 52. If the vent is open to fluid communication with the low-pressure side of pump 41, it may be useful to select the vent such that it can be closed during operation of the pump. In this way, the vent can be closed to avoid interference with the pump action. In the illustrated embodiment, the vent includes a port 56 openable to atmospheric pressure and a solenoid valve 58 to selectively open and close port 56. In the illustrated embodiment, port 56 is in communication with gas delivery line 40 downstream of the separator, however, it is to be understood that port 56 may be positioned in other various locations provided it is in fluid flow communication with the collection area and downstream of check valve 54. In addition, while a solenoid valve is shown in the illustrated embodiment, other valves or devices may be used to selectively open and close the collection area's vent to atmosphere.

A check valve 60 may be provided for vent, for example, on port 56 to prevent leakage of generated gases out through the vent.

In operation, separator 12 may be employed to separate entrained liquid from the generated gases passing therethrough. Separated liquid may accumulate in collection area 52. When it is desired to evacuate collection area and return the liquid to the electrolysis cells, electrolysis may be stopped and the pump operated to create a vacuum in the cells, which also generates a suction effect on return line 44. The collection area may then be vented to atmosphere, as by opening solenoid 58, so that the suction on line 44 may draw the separated liquid into return line 44 and therethrough back to cells 36. To facilitate evacuation where the pump is positioned, as shown, downstream of separator 12, pump 41 may be shut down prior to opening the solenoid 58. In the configuration as shown, check valve 54 will operate to substantially hold the vacuum pressure on the cells when pump is shut down.

After an appropriate period of time, such as a number of seconds, the solenoid valve 58 may be closed to close the collection area from atmospheric pressure and the electrolysis process and possibly pump operation may be reinitiated, if desired.

The process of pulling liquid from the pump may occur periodically, such as every two hours of system operation or less. In one embodiment, the process of pulling liquid from the collection area may be repeated every quarter of an hour of operation time or perhaps less. Alternately, the separator 12 may include a liquid level sensor 64 for the collection area, and the process of pulling liquid can be initiated when a liquid level sensor in the separator is tripped.

Figure 2:
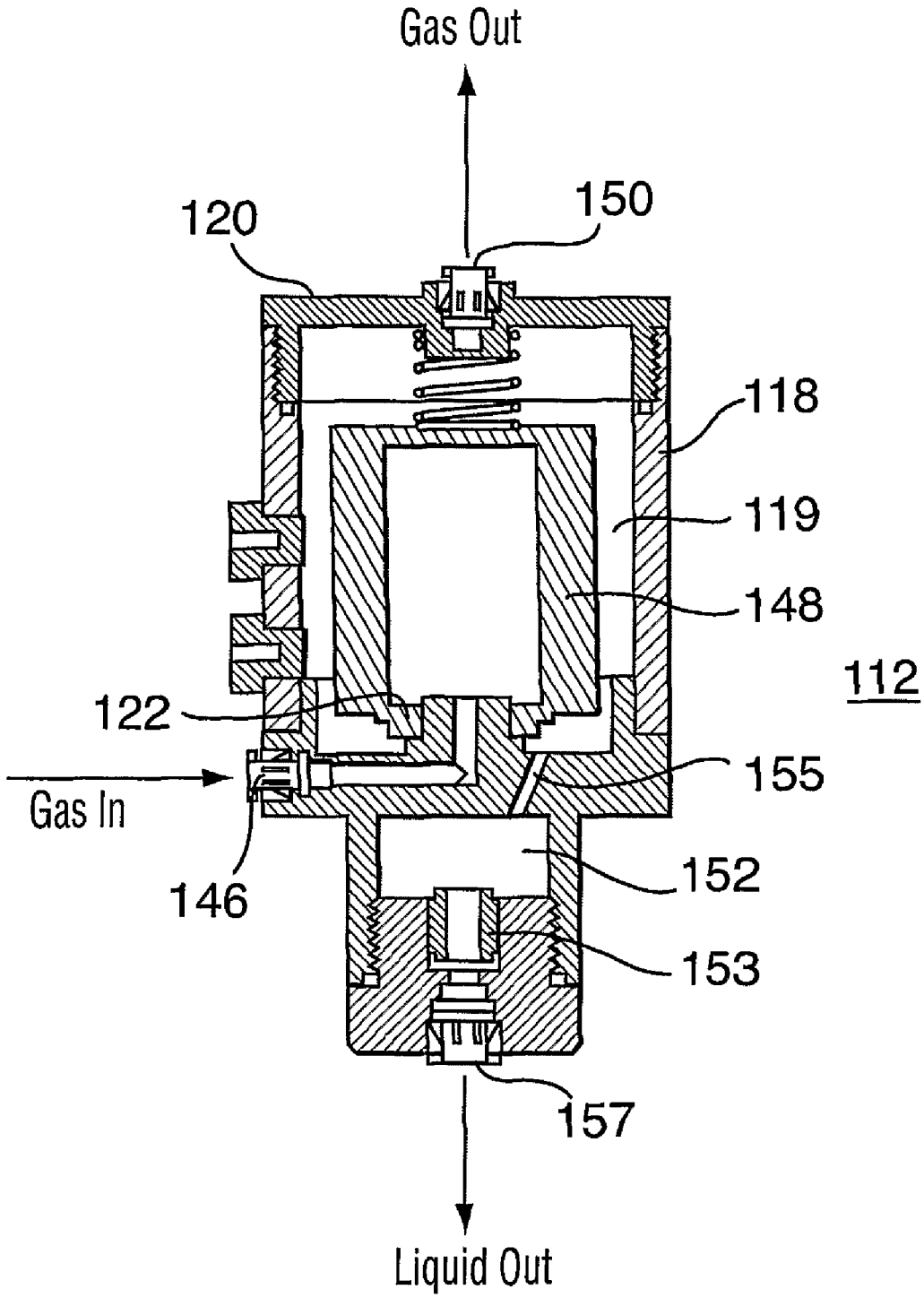
FIG. 2 is a sectional view of a gas liquid separator according to the present invention.

In one embodiment, as illustrated, a gas-liquid separator 112 may be used as shown in FIG. 2. In the illustrated embodiment, the separator 112 includes a housing made of plastic or other material compatible with the electrolyte solution used in the hydrogen generating system including a main body 118 defining therein an inner chamber 119 and including a gas inlet 146 through the body to the inner chamber, a cap 120 forming an upper limit of the inner chamber and including a gas outlet 150 and a coalescing medium 148 within the housing and in the gas flow path between inlet 146 and outlet 150. In the illustrated embodiment, coalescing medium is a pleated filter including a filter base 122 by which it is mounted in main body 118. The illustrated filter is pleated to provide the maximum possible surface area for the gas to pass through. While a pleated filter-form coalescing medium is shown, various other coalescing media such as condensers, other forms of filters, etc. may be employed with or to replace the pleated filter.

The gases enter the inner chamber of the separator via the inlet and are passed through coalescing medium 124 within the filter housing before the gases exit the separator through outlet 150. Separator 112 also includes an area 152 for collecting the coalesced droplets extracted by the coalescing medium. Area 152 may be out of the direct gas flow path and, in the illustrated embodiment, is a chamber separated by ports 155 from chamber 119. An outlet port 157 opens into area and may include a fitting to provide for connection of a return line (not shown). A check valve 153 may be included to permit only one way flow out of the area.

Coalesced liquid may flow through ports 155 into area 153. The separated liquid is collected in area 153 above valve 153 and returned via port 157 to the electrolysis cells of the hydrogen generating system.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A gas liquid separator system for a hydrogen generating apparatus, comprising: a housing including an inlet for wet gas, an outlet for dried gas and a coalescing medium therebetween for coalescing liquid from the wet gas; a collection area in fluid communication with the housing for collecting coalesced liquid; a liquid return line from the collection area connectable to an electrolysis electrolyte line; and a pump both for moving the wet gas from the inlet and through the coalescing medium and the dried gas into the outlet and for generating a suction effect on the liquid return line to draw coalesced liquid from the collection area.

2. The gas liquid separator system of claim 1 further comprising a vent for opening the collection area to a pressure equal to or greater than that of the suction effect.

3. The gas liquid separator system of claim 2 wherein the vent is a port openable to atmospheric pressure.

4. The gas liquid separator system of claim 1 wherein a gas flow path is set up between the inlet and the outlet and wherein the collection area is out of the flow path.

5. The gas liquid separator system of claim 1 further comprising a check valve on the liquid return line to substantially prevent fluid flow into the gas/liquid separator from the liquid return line.

6. A hydrogen generating apparatus comprising: an electrolysis cell for generating hydrogen gas; a gas delivery line to conduct the generated hydrogen gas toward an engine into which the hydrogen gas is to be introduced; a pump on the gas delivery line operable to generate a vacuum in the electrolysis cell; a gas liquid separator in the gas delivery line including a housing having an inlet for the generated hydrogen gas, an outlet for dried gas and a coalescing medium therebetween for generating coalesced liquid from the generated hydrogen gas; a collection area in fluid communication with the housing for collecting the coalesced liquid; and a liquid return line from the collection area to return the coalesced liquid to the electrolysis cell, the liquid return line being in communication with the electrolysis cell such that the vacuum created by the pump is communicated through the electrolysis cell to the liquid return line to create a suction effect for drawing coalesced liquid through the liquid return line to the electrolysis cell.

7. The hydrogen generating apparatus of claim 6 further comprising a vent for opening the collection area to atmospheric pressure.

8. The hydrogen generating apparatus of claim 7 wherein the vent is selectively openable and closable.

9. The hydrogen generating apparatus of claim 7 wherein the vent includes a port controlled by a solenoid valve.

10. The hydrogen generating apparatus of claim 9 wherein the port is in the gas delivery line downstream of the gas/liquid separator.

11. The hydrogen generating apparatus of claim 6 wherein the pump is positioned in the gas delivery line downstream of the gas/liquid separator.

12. The hydrogen generating apparatus of claim 6 further comprising a check valve in the gas delivery line between the electrolysis cell and the gas/liquid separator.

13. The hydrogen generating apparatus of claim 6 further comprising a control system to control the return of coalesced liquid to the electrolysis cell.

14. The hydrogen generating apparatus of claim 6 further comprising a control system to coordinate any of operation of the electrolysis cell to generate hydrogen gas; and operation of the pump to create a vacuum effect above the electrolyte of the electrolysis cell.

15. The hydrogen generating apparatus of claim 6 wherein the hydrogen generating apparatus further comprises a vent for opening the collection area to atmospheric pressure and a control system to coordinate any of opening of the vent, operation of the electrolysis cell to generate hydrogen gas; and operation of the pump to create a vacuum effect above the electrolyte of the electrolysis cell.

16. A method for separating liquid from the generated hydrogen gas generated by an electrolysis cell, the method comprising: passing the generated hydrogen gas through a gas/liquid separator to generated coalesced liquid and dried gas; collecting the coalesced liquid; and generating a vacuum effect on a return line extending between the gas/liquid separator and the electrolysis cell by operating a pump to draw the generated gas from the electrolysis cell to create a vacuum above electrolyte in the electrolysis cell and communicating the vacuum through the electrolyte to generate the vacuum effect on the return line; and allowing the coalesced liquid to be drawn from the gas/liquid separator back to the electrolysis cell including holding the vacuum above the electrolyte, while exposing the coalesced liquid in the gas/liquid separator to a pressure greater than that of the vacuum effect.

17. The method for separating liquid of claim 16 wherein holding the vacuum includes stopping the pump and substantially preventing flow of gas back into the electrolysis cell.

18. The method for separating liquid of claim 16 wherein opening the coalesced liquid in the gas/liquid separator to a pressure greater than that of the vacuum effect includes opening the coalesced liquid to atmospheric pressure.

19. The method for separating liquid of claim 16 wherein prior to generating a vacuum effect any electrolysis process in the electrolysis cell is stopped.

* * * * *